United States Patent [19]

Ginn et al.

[11] Patent Number: 4,492,135

[45] Date of Patent: Jan. 8, 1985

[54] APPARATUS FOR HANDLING THIN SHEETS OF MATERIAL

[75] Inventors: Ian D. Ginn, Sale; Leonard Gleave, Davyhulme; Leslie Woods, Altrincham, all of England

[73] Assignee: Metal Box Public Limited Company, Reading, England

[21] Appl. No.: 426,750

[22] Filed: Sep. 29, 1982

[30] Foreign Application Priority Data

Sep. 29, 1981 [GB] United Kingdom ..... 8129371

[51] Int. Cl.[3] ..... B65H 7/08

[52] U.S. Cl. ..... 83/155; 83/157; 83/430; 83/436; 83/500; 271/251; 271/261; 271/271

[58] Field of Search ..... 83/404, 407, 436, 155, 83/425.4, 430, 157, 500–503, 408–409, 364, 367, 420–421; 271/233, 251, 261, 271, 269; 29/113 R; 226/191, 192

[56] References Cited

U.S. PATENT DOCUMENTS

| | | | |
|---|---|---|---|
| 2,355,079 | 8/1944 | Jones | 83/407 |
| 2,668,591 | 2/1954 | Winters | 83/407 |
| 2,672,931 | 3/1954 | Maher | 83/407 |
| 2,995,364 | 8/1961 | Frederick | 271/251 |
| 3,633,493 | 1/1972 | Helminen | 29/113 AD |
| 4,014,539 | 3/1977 | Goodwin | 271/251 |
| 4,045,196 | 8/1977 | Schaefer | 83/347 |
| 4,224,850 | 9/1980 | Holmi et al. | 83/430 |

FOREIGN PATENT DOCUMENTS

| | | | |
|---|---|---|---|
| 388877 | 4/1972 | U.S.S.R. | 29/113 AD |

*Primary Examiner*—James M. Meister
*Assistant Examiner*—John L. Knoble
*Attorney, Agent, or Firm*—Diller, Ramik & Wight

[57] ABSTRACT

A high speed slitter for slitting large sheets (3) of thin metal into rectangular strips has pairs of rollers (10, 10') mounted on parallel, driven shafts (12, 13). Each roller has a hub (98, 98') carrying a cutter ring (100, 100') with a circular cutting edge (112). A draw ring (92, 92'), cooperating with the opposite cutting ring (100', 100) to draw the sheet between the rollers, consists of a resilient ring (94, 94'), gripping the hub but capable of slipping around it when subjected to sufficient appropriate force, and a steel tire (96, 96'), carried only by the resilient ring and engaging the sheet. The tire can be deflected radially by virtue of the resilient ring.

18 Claims, 12 Drawing Figures

1
2
3
4
5
6
7
8
10
12
14
18
20
21
22
23
24
26
28
32
34
36
38
50
52
54
60
62
63
64
66
68
74
82
84
86
102
II
III 97
112
114
96
100
94
92
10
12
98
99
101
95
3
96'
100'
94'
92'
10'
97'
98'
101'
13

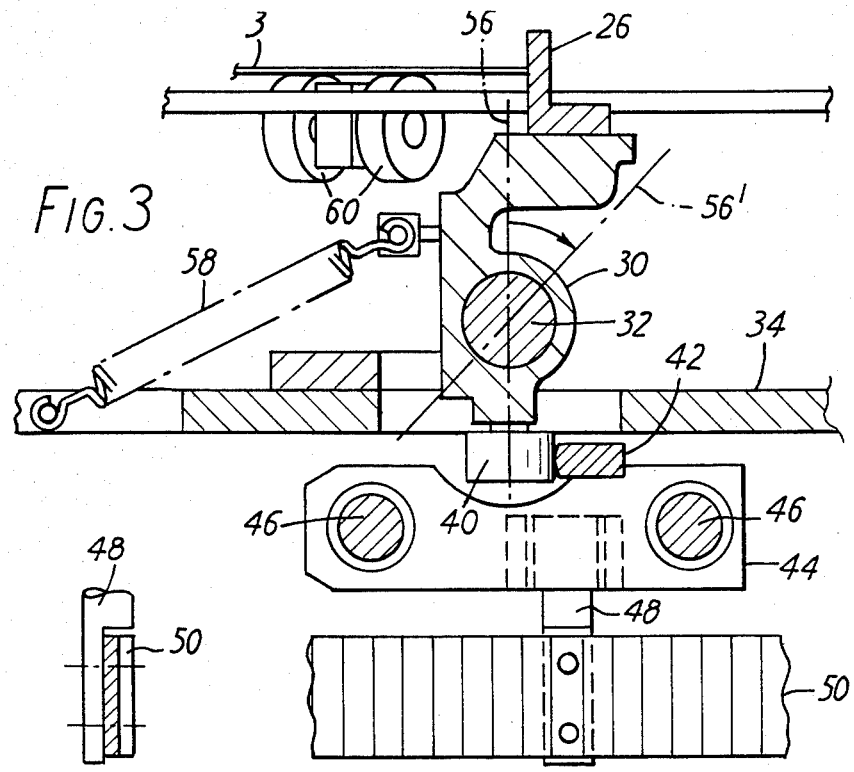
FIG. 3
FIG. 4
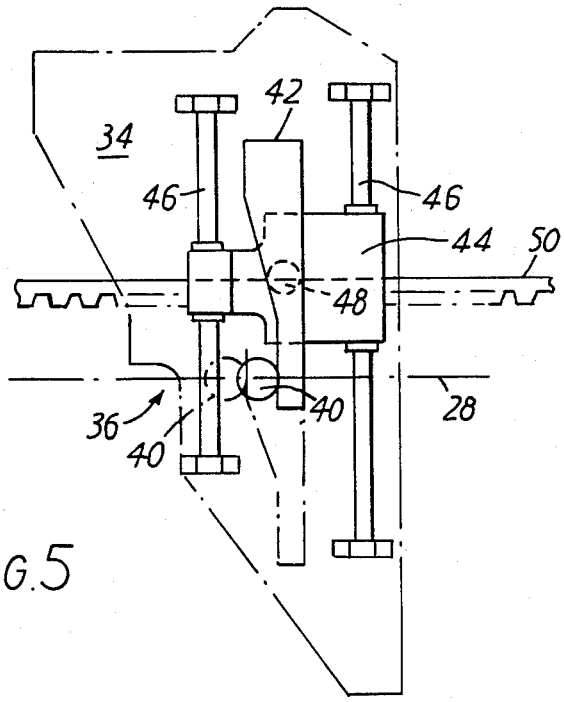
FIG. 5

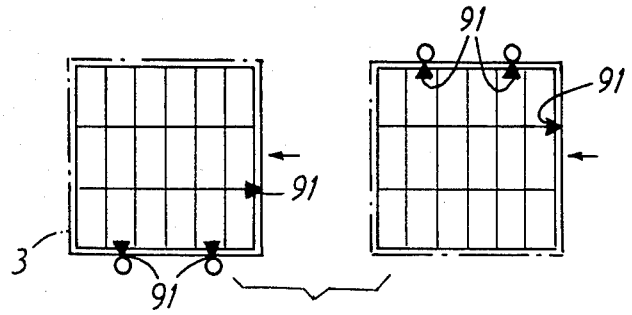
FIG. 10a
FIG. 10b
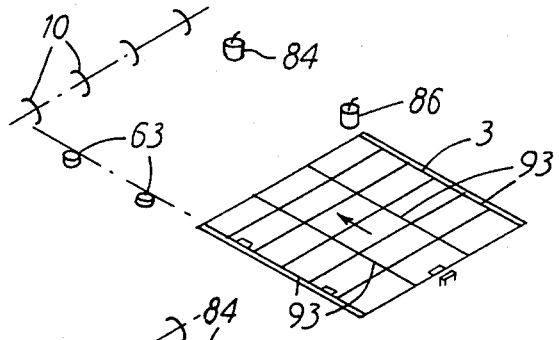
FIG. 10c
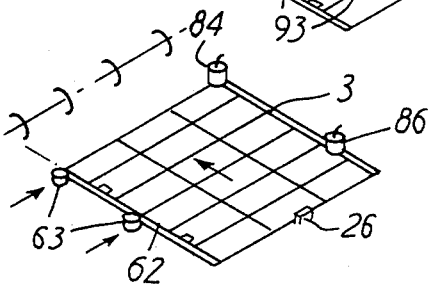
FIG. 10d
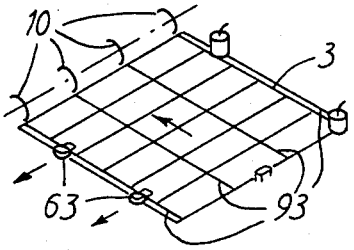

APPARATUS FOR HANDLING THIN SHEETS OF MATERIAL

FIELD OF THE INVENTION

This invention relates to apparatus for handling thin sheets of material, for example thin metal sheets or sheets of paperboard or plastics material, where the sheets are flexible but have yet a significant degree of stiffness such that they can be fed, in a flat state, between rollers, arranged in cooperating pairs for this purpose, but where the pairs of rollers are spaced from each other across the path of the sheet.

DISCUSSION OF THE INVENTION

The invention is directed especially, though not exclusively, to apparatus for handling, at high speeds, metal sheet intended for use in the manufacture of steel or aluminium cans, such sheet being either uncoated, or having a protective coating of lacquer or the like on one or both of its sides. The sheet may be printed on at least one side. Such apparatus includes slitting machines, or slitters, for cutting very large sheets of the metal into strips before the strips are subsequently cut into individual flat blanks which are then formed into can bodies or the like; or feeding apparatus for printing or coating machines. The metal sheet is flat but very thin, and has some degree of flexibility; therefore the higher the speed at which it is to be fed, the greater is the possibility of damage if the leading edge of the sheet fails to enter between the rollers smoothly and easily. In addition, it is essential that no damage be caused by the rollers to the printing on the sheet, or to any protective coating that may have been applied thereon. Another problem is that, although the large metal sheet may not be perfectly rectangular, due to its opposite side or end edges (or both) not being perfectly parallel, it is nevertheless essential that the sides of each of the strips cut from the sheet by the stripper shall be perfectly parallel to each other; and furthermore these sides must be correctly orientated with respect to any printed matter on the strip. Finally, whilst the sheet is substantially flat, there may be local variations in its flatness, such as bumps or dents, such that, at any transverse cross-section of the sheet, the section may not be a perfectly straight line.

It is accordingly desirable that the pairs of rollers, abovementioned, shall be able to receive the leading edge of the sheet gently but firmly, through as great a proportion of the axial length of the rollers as possible but in a manner such as not to damage the coating or printed matter by scratching or by impact; that the rollers should be able to accommodate, and tend to remove, any bumps, dents or the like; and that the rollers shall be able nevertheless to receive and feed the sheet forward in a perfect straight line.

Apparatus for handling thin sheets of material and comprising at least one pair of rollers, for cooperating with each other to draw a said sheet tangentially between them, and drive means for rotating said rollers, each roller comprising a rigid roller body carrying a respective circumferential roller surface for engaging the sheet between the two roller surfaces, one roller of the pair having a first said roller surface which is immovable circumferentially with respect to the corresponding roller body, and the other roller having a draw ring encircling its body, the roller surface of said other roller being defined on the draw ring, will be referred to as "apparatus of the kind specified".

Apparatus of the kind specified is known in which the first roller surface of each roller is a circumferential surface formed on a cutter ring rigidly secured to the roller body, whilst the draw ring is a stiff ring carried by roller bearings on the roller body. Each draw ring is aligned with the first roller surface of the other roller of the pair, so that the sheet is drawn through the rollers by the first roller surfaces only, the draw rings being freely rotatable on their bearing rollers and acting only as guides to hold the sheet firmly in contact with the first roller surfaces. In order to obtain a reasonable measure of protection from damage to the coating or printed matter, extreme accuracy must be achieved in the radial spacing between the rollers of each pair, and this is difficult to achieve in practice.

The invention provides apparatus of the kind specified in which the draw ring comprises a resilient ring member, resiliently gripping the roller body, and a tyre carried by and encircling the ring member and having the roller surface of the draw ring, whereby the draw ring is capable of limited rotation about the corresponding roller body such as substantially to prevent slippage between either of the roller surfaces and a said sheet when the latter is engaged between the rollers.

Preferably the tyre is mounted on the corresponding roller body so as to define a radial clearance therebetween, the resilient ring being radially resilient so that the tyre is capable of limited yielding movement into eccentricity with respect to the roller body.

In preferred embodiments of the apparatus, each roller body comprises a generally-cylindrical hub and an annular cutter rigidly secured coaxially around the hub, the cutter having said first roller surface terminating in a circumferential cutting edge, and the cutting edges of the rollers of said at least one pair being arranged substantially in a common radial plane for slitting longitudinally a said sheet drawn between the rollers. Such apparatus is preferably a slitter for sheet metal and comprising sheet feeding means for feeding a succession of sheets in a linear forward direction, slitting means mounted transversely over the forward end of the feed means for slitting the sheet to form a plurality of sheet metal strips, and strip-receiving means immediately forward of the slitting means for receiving the strips and delivering them to exit conveyor means, wherein the slitting means comprises a pair of transverse cutter shafts rotatably mounted on parallel axes one above the other and carrying said at least one pair of rollers.

Other preferred features of such a slitter include:

(1) A simple feed drive whereby pusher dogs are carried by a carriage reciprocated back and forth by an endless belt, travelling at constant speed and having two co-planar parallel runs, which is attached to a shuttle. The shuttle is carried by the carriage and is moved transversely of the machine as the point to which it is attached on the belt passes around the belt pulleys, the axes of which are vertical. The shuttle operates a can mechanism which tilts the dogs backwards for the return stroke of the carriage and restores them to their pushing position for the working stroke.

(2) A solenoid-operated side gauge, electrically coupled to sheet sensors on the opposite side of the machine to align the sheet accurately with the slitter cutters.

(3) Drop rails (for receiving the cut strips from the cutters) which rotate in one direction, being driven by a constant-speed endless belt through a simple cam and trip lever mechanism which trips the drop rails once in every revolution to drop the strip and then restore the rails to their strip receiving position by continued rotary movement in the same direction.

It will be understood that apparatus according to the invention may be employed with, or adapted within the scope of the invention for the handling of, sheets of material other than metal; for example plastics or paperboard.

A slitting machine (slitter) for sheet metal will now be described, by way of example only, with reference to the accompanying drawings.

BRIEF DESCRIPTION OF THE DRAWINGS

FIG. 3 is a simplified sectional scrap elevation on the line III—III in FIG. 1, showing part of a feed drive;

FIG. 4 is a scrap view showing a drive belt of the feed drive attached to a drive pin on a shuttle of the feed drive;

FIG. 5 is a simplified plan view showing the operation of the shuttle and a cam associated therewith;

FIGS. 8 to 10 illustrate the operation of the sheet sensors and side gauges of the slitter;

DESCRIPTION OF THE PREFERRED EMBODIMENT

The slitter now to be described is a slitting machine for slitting, with extreme accuracy and at high speed, thin sheets of metal, usually preprinted, to be made into can bodies. This slitter is intended to perform the first cut, i.e. to slit the large pre-printed sheet lengthwise into a number of strips each of which will subsequently be transversely cut into separate pieces each of which is then formed into a can body cylinder.

Figure 1:
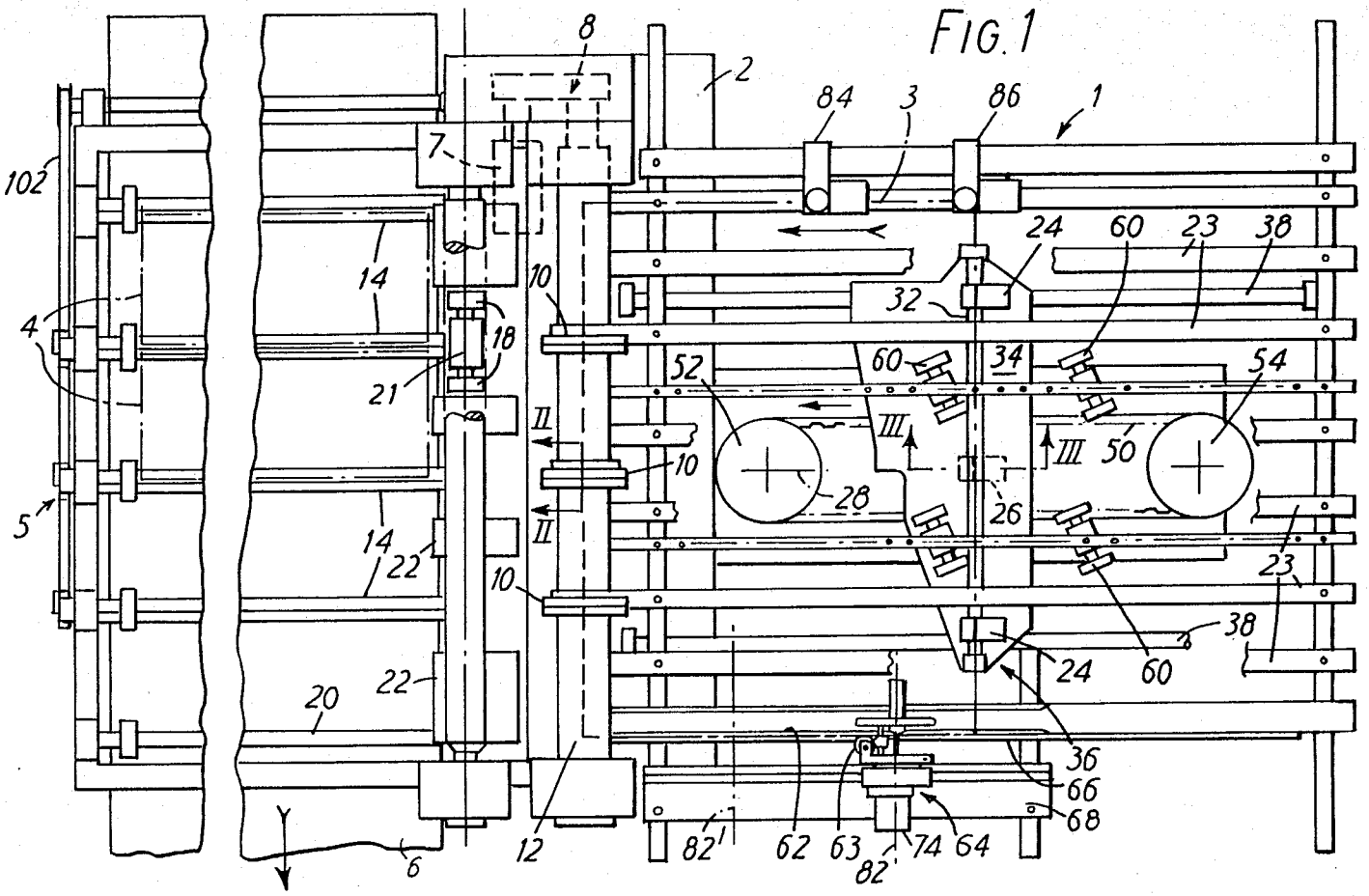
FIG. 1 is a simplified plan of the slitter.

As is shown in FIG. 1, the slitter has a feed unit 1 carried on a machine base (not generally shown) which also includes a housing 2 containing a main drive motor of the slitter and appropriate drives connecting the main drive motor to the various moving parts seen in the drawings.

An upper cutter shaft 12 is mounted rotatably on the housing 2 with its axis horizontal and transverse to the feed unit 1. Mounted on the shaft 12, for rotation therewith, is a set of rollers 10. A lower cutter shaft, not visible in FIG. 1, is similarly mounted with its axis vertically below, and parallel with, that of the upper shaft 12, and carries a similar set of rollers, each of which cooperates with a respective one of the rollers 10 of the upper shaft and lies directly below it. The two cutter shafts are driven by the above-mentioned drives, always at substantially the same speed as each other. For present purposes the main drive motor is indicated diagrammatically in FIG. 1 at 7 and the drive from the motor to the cutter shafts at 8.

An uncut, pre-printed, approximately rectangular sheet of thin metal is shown in phantom lines at 3 on the feed unit 1, with its leading end between, and engaged by, the rollers 10 on the upper cutter shaft 12 and those on the lower cutter shaft. All of these rollers include cutters which slit the sheet into substantially rectangular strips 4, two of which are shown resting on drop rails 14 which are part of a transfer unit 5 of the slitter. The drop rails deliver the strips 4 to an exit conveyor 6.

The strips 4 are drawn between the upper and lower cutters and delivered on to the drop rails 14 by an upper draw roller 16, cooperating with pairs of idle lower draw rollers 18, each pair of the latter being carried by a respective short, transverse shaft whose axis lies vertically below, and parallel with, the horizontal transverse axis of the upper draw roller 16. Like the cutter shafts 12, the draw rollers 16 are driven by the appropriate above-mentioned drive from the main drive motor. The short shaft of each pair of lower draw rollers is carried by a support bearing in a respective one of a set of fixed bearing blocks 21, each of which also carries an end bearing which rotatably supports the rear end of a respective one of a set of drop rails 14 (and of an idle support rail 20, at one end of the unit 5) which form part of the transfer unit. Fixed dead plates 22 are provided to help to guide the strips 4 on to the rails 14 and 20.

Figure 2:
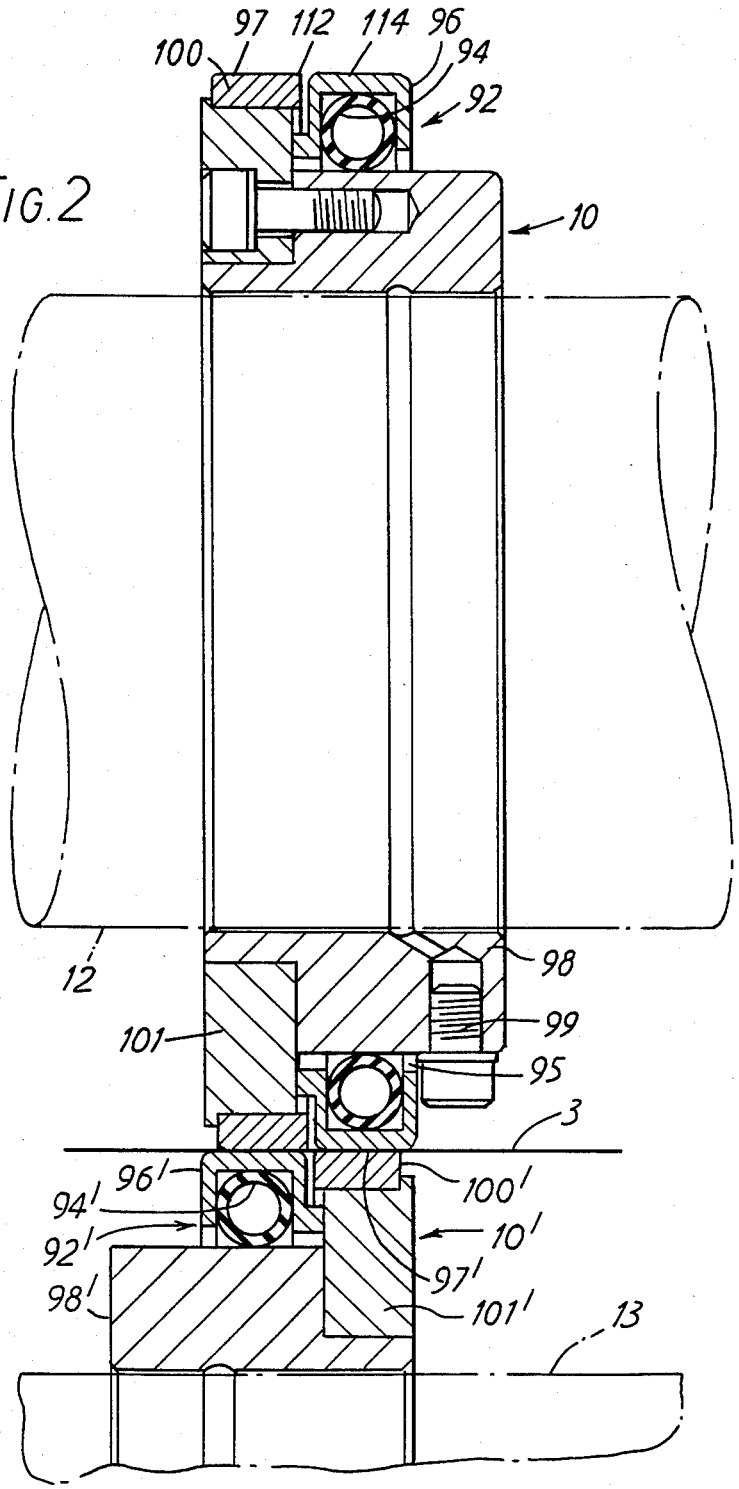
FIG. 2 is a sectional end elevation, taken on the line II—II in FIG. 1, and illustrating a pair of rollers which cooperate with each other to perform slitting operations on sheet metal.

Referring now to FIG. 2, parts of the upper cutter shaft 12 and the lower cutter shaft, 13, are indicated in phantom lines. FIG. 2 shows one of the upper rollers 10, and at 10' the adjacent portion of the identical lower roller with which the roller 10 cooperates.

The various parts identified by reference numerals 92, 94, 96, 97, 98, 100 and 101, in respect of the upper rollers 10, have counterparts in the lower rollers 10' identified by the respective reference numerals 92', 94', 96', 97' 98', 100' and 101'. Since the upper and lower rollers are all the same as each other, only one upper roller 10 need be described now.

The roller 10 comprises a rigid roller body in the form of a cutter hub 98, a cutter ring 100 and a mounting ring 101. The cutter ring 100 has a circumferential first roller surface which, because the cutter ring is secured around the hub 98 by means of the mounting ring 101, can be seen to be immovable circumferentially with respect to the roller body 98, 100, 101.

The hub 98 is mounted on the cutter shaft 12 by an interference fit. The axial position of the hub on the shaft may be pre-set in known manner by applying temporary hydraulic pressure within the bore of the hub, through an inlet 99 for an appropriate fluid under pressure, so as to expand the hub radially by an amount just sufficient to enable the hub to slide on the shaft, so that its axial position may be readily adjusted.

Mounted around the hub 98, axially adjacent to the cutter ring 100, is a draw ring 92 in the form of a hollow rubber ring 94 carrying a steel tyre 96 having a cylindrical, sheet-engaging roller surface 114. FIG. 2 shows that the steel tyre 96 is of relatively heavy channel section and since made of steel, it is, of course, relatively rigid as compared with the hollow, resilient rubber ring 94. The tyre 96 is carried entirely by the ring 94, so that any movement of the latter around the hub 98 will tend to be accompanied by corresponding rotational movement of the tyre about the hub. However, it is important to note that the draw ring is normally held firmly on to the hub 98 by virtue of the resilience of the ring 94. In other words, the tyre 96 is restrained by the latter against free rotation around the hub, whilst still being able to move rotatably if subjected to an appropriate tangential force of sufficient magnitude such as to force the ring 94 to slip or creep around the hub. It follows, of course, that the draw ring is not secured against circumferential movement with respect to the roller body 98, 100, 101.

It should be noted that there is a radial clearance (indicated in FIG. 2 at 95) between the tyre 96 and the hub 98, and that the rubber ring 94 is in the form of a continuous hollow ring of toroidal cross-section, capable of being deformed radially, so that the tyre can deflect radially into a state of eccentricity with respect to the axis of the shaft 12 whilst still exerting a radial force on the sheet 3 by virtue of the ring 94. The facility for such radial deflection (by very small amounts) is of advantage in the event that the sheet 3 has slight local deviations from a state of perfect flatness, since it minimises the danger of damage to the roller surfaces, or to the sheet 3 or any printed matter on either side of the latter.

The roller surface 97 of the cutter ring terminates in a circumferential cutting edge 112. As can be seen from FIG. 2, the axial portions of the two rollers 10, 10' of a pair are adjusted so as to align the cutting edge 112 with that of the roller 10' in substantially a common vertical plane. Thus arranged, the roller surface 97 of the upper roller 10 overlies and is radially opposed to the draw ring roller surface of the lower roller 10' whilst the draw ring roller surface of the upper roller similarly overlies and is radially opposed to the roller surface 97' of the lower roller, so that the radially opposed surfaces in each case cooperate to draw the sheet 3 between the rollers. To this end, the radial clearance between the two cutter assemblies is such that the sheets 3 can pass between them in frictional contact with the draw ring tyres 96, 96' and with the cutter rings 100 and 100'. Thus, in operation, because the rubber rings 94 and 94' are normally held on to the hubs by virtue of their own resilience, a positive frictional forward driving force is exerted on the sheet 3, not only by the roller surfaces 97, 97' of the cutter rings 100 and 101', but also by the draw rings 92 and 92'.

If the shafts 12 and 13 are rotating at exactly the same speed, then there will be no slippage between the draw rings on the one hand, and, on the other hand, the cutter rings separated from them by the sheet 3. Should there arise any circumstances tending to cause such slippage, however (such as a slight variation in speed between the two shafts), the draw rings will tend to slip around their hubs 98 and 98' in such a direction, and at such a velocity, as to eliminate or avoid such slippage.

The feed unit 1 has slide rails 23 over which successive sheets 3 are pushed either by two pusher dogs 24 or by one pusher dog 26. The dogs 24 and 26 lie on the longitudinal centre line 28 of the slitter, the dogs 24 being spaced on either side of the dog 26.

Referring to FIG. 3, all three of these pusher dogs are mounted (with a facility for fine adjustment of their longitudinal position) on support levers 30 fixed to a transverse dog bar 32. The latter is rotatably mounted on the baseplate 34 of a carriage 36 which includes the dogs and their associated parts. The dog support levers 30 are biassed upright by tension springs 58, whilst the baseplate 34 is mounted for freely sliding along a pair of fixed bars 38. Referring to FIG. 5 (in which the baseplate 34 is shown only in phantom lines) as well as to FIG. 3, the central one of the dog support levers 30 carries a cam follower 40, engaging a cam plate 42 which is fixed to a shuttle 44. The shuttle 44, whch is freely slidable transversely along two bars 46 fixed to the underside of the baseplate 34, has a bearing carrying a depending drive pin 48 which is fixed to a toothed, endless belt 50 as seen in FIGS. 3 and 4. This belt 50 has two parallel runs between a drive pulley 52 and idle pulley 54.

The pulley 52 is driven at constant speed from the main drive motor, so as to advance the carriage (to the left in FIG. 1) and then return it to the sheet-receiving position at the right-hand side of FIG. 1. The dogs are lowered against the action of the springs 58 for this return stroke by the action of the cam plate 42. A plane 56 containing the axis of the dog bar 32 is vertical when the dogs are in their upright or operating position; the position of the plane 56 when the dogs are lowered is shown at 56' in FIG. 3. If any dog is not required, it is removed from its support lever 30.

Figure 6:
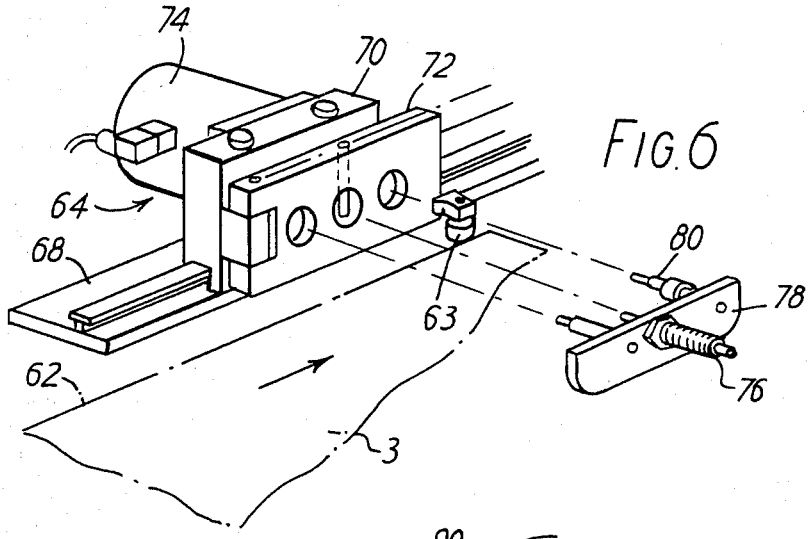
FIG. 6 is an exploded view of a solenoid-operated side gauge.

The feed unit 1 includes a set of idle bias rollers 60 whose horizontal axes are inclined with respect to the forward direction as seen in FIG. 1. The rollers 60 ensure that the left-hand side edge 62 of the sheet 3, looking in the direction of travel, is urged constantly against the roller 63 of a side gauging unit 64. The gauging edge 62 is supported on a fixed, raised rail 66 to ensure that the edge 62 is at the correct level. The unit 64 is mounted on a rigid support plate 68 along which its position is adjustable. The unit 64 comprises a body 70 to which a gauging arm 72, carrying the roller 63, is hinged (see FIG. 6). Movement of the arm 72 from its normal retracted position is effected by a solenoid 74 against a hydraulic damper 76, having adjustable degrees of damping and mounted on a damper plate 78 having an adjuster 80 to effect fine adjustment of the throw (extent of transverse movement) of the roller 63. The axis of the solenoid is indicated at 82 in FIG. 1. A further and similar unit 64 is required, as indicated by the axis 82' in FIG. 1, if only one pusher dog is being used.

Figure 7:
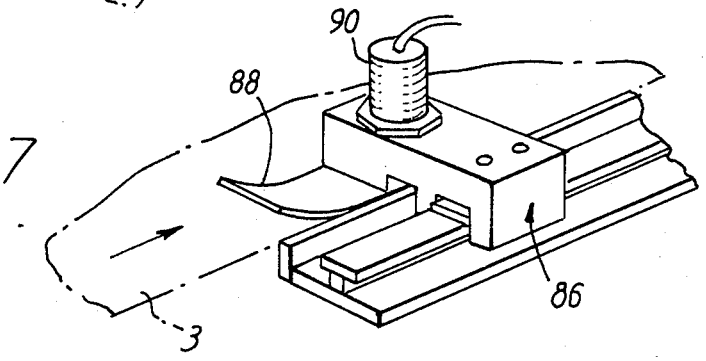
FIG. 7 is a perspective view of a sheet sensor.

At the opposite side of the feed unit 1 are two sensors 84 and 86, mounted on a rigid, fixed bar for longitudinal adjustment. Each sensor has a sheet guide plate 88 and comprises an electrical proximity switch 90 (see FIG. 7) which is electrically connected, through suitable switching means if necessary, to the solenoid or solenoids 74, so as to position the side gauging roller or rollers in the exact position necessary to locate the sheet edge 62 so that the slitter cutters will cut along the required longitudinal lines 93 (FIGS. 9 and 10).

Figure 8:
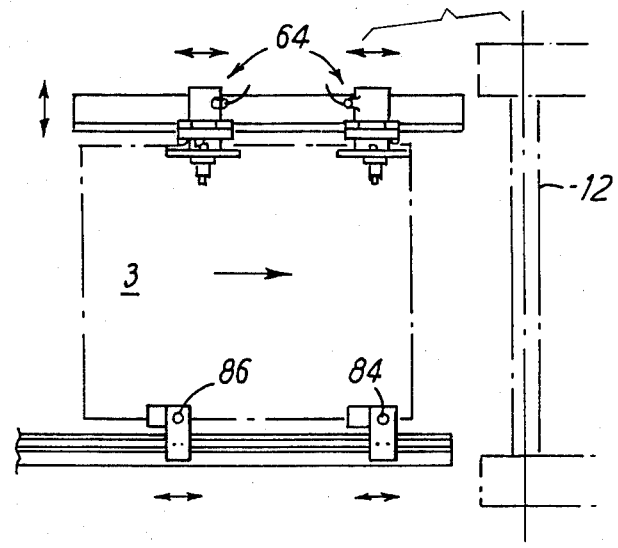
Figure 9A:
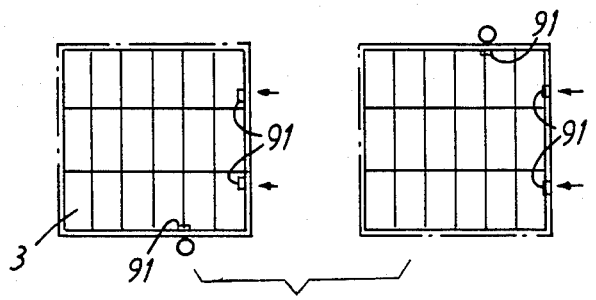
Figure 9B:
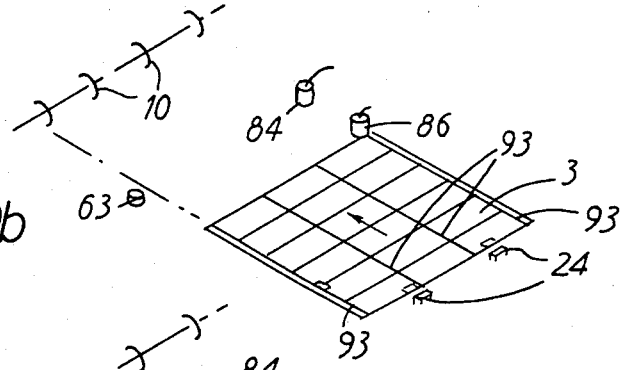
Figure 9C:
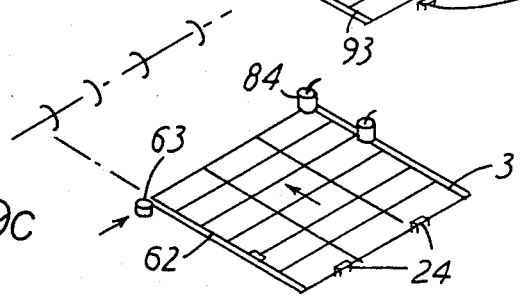
Figure 9D:
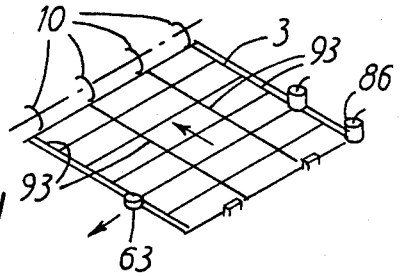

FIG. 8 shows two side gauging units 64 and the two sensors 84, 86, and illustrates the facility, not only for longitudinal adjustment of these components but also the fact that the transverse distance between them can be varied. Thus a wide range of sheet sizes can be handled.

FIGS. 9 and 10 show diagrammatically how the sheet 3 is positioned accurately for presentation to the cutters 10 in a "normal stencil" orientation and a "cross stencil" orientation, respectively. The sheets have previously been printed by a machine which utilises gauge points 91 to register the position of print on the sheet 3. The gauge points 91 are eventually used for setting up the slitter, and are on the lines transverse to the direction of printing (see FIGS. 9(*a*) and 10(*a*)). Accordingly, where the latter direction is also the direction of slitting ("normal stencil"), the rear edge of the sheet is used as datum for longitudinal alignment, the outer dogs 24 being used with a single side gauging unit. If the printing direction is perpendicular to the slitting direction ("cross stencil"), the side edge 62 is used as datum for longitudinal alignment as well as transverse position. Hence, as seen in FIG. 10, two side gauging units are used but only the centre dog 26.

In operation, the rear edge of a sheet 3, delivered to the slitter by conventional means (not shown) is engaged by the dog or dogs upon raising of the latter by the springs 58 when the carriage 36 is at the extreme right-hand position in FIG. 1. The carriage and bias rolls then urge the sheet forward, FIGS. 9(*b*) and 10(*b*). When the leading edge of the sheet reaches the forward sensor 84, which in practice is immediately opposite the roller 63, the sensor 84 detects the sheet and causes the solenoid or solenoids 74 to be energised, advancing the roller or the rollers 63 to the correct position which nudges the sheet into its required transverse position. The leading edge is engaged by the draw rings 92 upon engagement of the roller or rollers 63 with the appropriate gauge point or points 91. At this moment also, the rear sensor 86 detects the rear edge of the sheet and causes the solenoid or solenoids to retract the roller or rollers 63.

Figure 11:
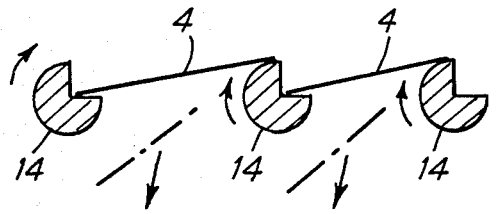
FIG. 11 shows three drop rails in end section to illustrate their operation.
Figure 12:
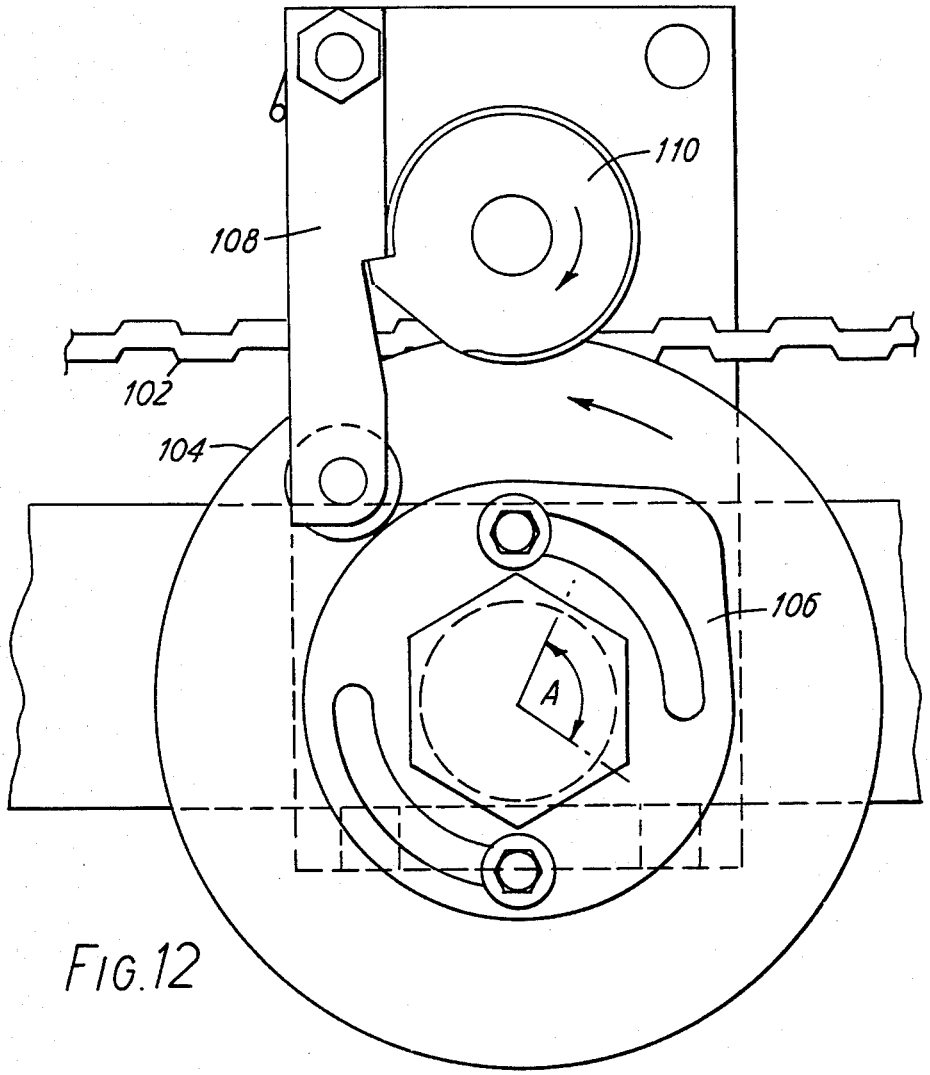
FIG. 12 is an outside elevation of a drop rail actuating mechanism.

The drop rails 14 have the cross-section seen in FIG. 11, being cylindrical with a quadrant-shaped cut-out in which one side edge of the appropriate metal strip 4 rests, the opposite side of the strip falling on to the top of the next rail 14. An endless toothed belt 102, FIG. 12, driven at constant speed from the main drive motor, rotates a belt pulley 104, once per machine cycle. The pulley 104 carries a cam 106 which operates a trip lever 108 to release a trip wheel 110, which is arranged so that, when it is held by the lever 108, it holds disengaged a spring clutch (not shown.) The clutch, when engaged by release of the trip wheel 110, couples the drop rail with a belt pulley (not shown), such that the drop rail is rotated one complete revolution during an arc, indicated at A, of the rotation of the cam 106. The strips 4 thus fall on to the conveyor 6. In a modification, the clutch and second belt pulley are eliminated, the drop rail being operated directly from the cam 106 through a cam follower arm on the drop bar shaft, the cam follower being held in contact with the cam by a torsion spring and the cam being appropriately profiled. The timing of the drop rail operation is adjusted by adjusting the rotational position of the cam.

It will be appreciated that many variations are possible within the scope of the invention. For example there may be only a single pair of rollers 10, 10' so that the sheet 3 is slit into only two strips. Any other desired number of pairs of rollers (provided there is room on the shafts) may be provided.

Apparatus within the scope of this invention need not be a slitter for sheet metal, or even a slitter at all. If slitting or cutting is not required, the cutting edges 112 will be absent. If the purpose of the pairs of rollers equivalent to the rollers 10 and 10' is merely to provide accurate drawing of the sheet of material from the sheet feeder, the rigidly-carried roller surface such as 97 or 97' need not necessarily be provided on one of the rollers of the pair. In such a case it will be this roller that carries the draw ring, the latter cooperating with the rigidly-carried roller surface, equivalent to 97 or 97', of the other roller.

The draw rings may have support or cushioning rings (such as for example the ring 94) of any suitable cross-section and of any suitable resilient material, i.e. they are not necessarily of hollow, toroidal cross-section and not necessarily of rubber.

We claim:

1. Apparatus for handling thin sheets of material, such apparatus comprising at least one pair of rollers, for cooperating with each other to draw a said sheet tangentially between them, and drive means for rotating said rollers, each roller comprising a rigid roller body carrying a respective circumferential roller surface for engaging the sheet between the two roller surfaces, one roller of the pair having a first said roller surface which is immovable circumferentially with respect to the corresponding roller body, and the other roller having a draw ring encircling its body, the roller surface of said other roller being defined on the draw ring, wherein the draw ring comprises a resilient ring member, resiliently gripping the roller body, and a relatively rigid tyre carried entirely by and encircling the ring member and having the roller surface of the draw ring, the draw ring being unsecured against circumferential movement with respect to the roller body, whereby the draw ring, as a whole, is capable of limited rotation about the corresponding roller body such as substantially to prevent slippage between either of the roller surfaces and a said sheet when the latter is engaged between the rollers.

2. Apparatus according to claim 1, wherein the tyre is mounted on the corresponding roller body so as to define a radial clearance therebetween, the resilient ring being radially resilient so that the tyre is capable of limited yielding movement into eccentricity with respect to the roller body.

3. Apparatus according to claim 1, wherein each roller has a draw ring and a said first roller surface, the first roller surface of each roller being radially opposed to the draw ring roller surface of the other roller, for sheet-engaging cooperation therewith.

4. Apparatus according to claim 2, wherein each roller has a draw ring and a said first roller surface, the first roller surface of each roller being radially opposed to the draw ring roller surface of the other roller, for sheet-engaging cooperation therewith.

5. Apparatus according to claim 3 or claim 4, wherein each roller body comprises a generally-cylindrical hub and an annular cutter rigidly secured coaxially around the hub, the cutter having said first roller surface terminating in a circumferential cutting edge, and the cutting edges of the rollers of said at least one pair being arranged substantially in a common radial plane for slitting longitudinally a said sheet drawn between the rollers.

6. Apparatus according to claim 3 or claim 4, being a slitter for sheet metal and comprising sheet feeding means for feeding a succession of sheets in a linear forward direction, slitting means mounted transversely over the forward end of the feed means for slitting the sheet to form a plurality of sheet metal strips, and strip-receiving means immediately forward of the slitting means for receiving the strips and delivering them to exit conveyor means, wherein the slitting means comprises a pair of transverse cutter shafts rotatably mounted on parallel axes one above the other and carrying said at least one pair of rollers. wherein each roller body comprises a generally-cylindrical hub and an annular cutter rigidly secured coaxially around the hub, the cutter having said first roller surface terminating in a circumferential cutting edge, and the cutting edges of the rollers of said at least one pair being arranged substantially in a common radial plane for slitting longitudinally a said sheet drawn between the rollers.

7. Apparatus according to any one of claims 1 to 4, wherein the draw ring roller surfaces are substantially cylindrical.

8. Apparatus according to any one of claims 1 to 4, wherein the or each resilient ring member is of toroidal cross-section.

9. Apparatus according to any one of claims 1 to 4, wherein the or each resilient ring member is of rubber.

10. Apparatus according to claim 1 wherein the or each resilient ring member is a hollow O-ring.

11. Apparatus according to claim 2 wherein the or each resilient ring member is a hollow O-ring.

12. Apparatus according to claim 3 wherein the or each resilient ring member is a hollow O-ring.

13. Apparatus according to claim 4 wherein the or each resilient ring member is a hollow O-ring.

14. Apparatus according claim 1 wherein the or each relatively rigid tyres is an annular ring of a radially inwardly opening U-shaped cross-section.

15. Apparatus according to claim 2 wherein the or each relatively rigid tyres is an annular ring of a radially inwardly opening U-shaped cross-section.

16. Apparatus according to claim 3 wherein the or each relatively rigid tyres is an annular ring of a radially inwardly opening U-shaped cross-section.

17. Apparatus according to claim 4 wherein the or each relatively rigid tyres is an annular ring of a radially inwardly opening U-shaped cross-section.

18. Apparatus according to claim 10 wherein the or each relatively rigid tyres is an annular ring of a radially inwardly opening U-shaped cross-section.

* * * * *